United States Patent [19]

Kirby et al.

[11] Patent Number: 4,457,627

[45] Date of Patent: Jul. 3, 1984

[54] CIRCULAR CONTAINMENT SYSTEM FOR WELL DRILLING FLUID

[76] Inventors: Robert E. Kirby, 427 Avenue A, LaMarque, Tex. 77568; Jacob L. Brewer, Black Jack, Hardin, Tex. 77575

[21] Appl. No.: 365,522

[22] Filed: Apr. 5, 1982

[51] Int. Cl.[1] ..... B28C 5/08

[52] U.S. Cl. ..... 366/65; 366/302; 366/307

[58] Field of Search ..... 360/65, 66, 279, 306, 360/307, 302

[56] References Cited

U.S. PATENT DOCUMENTS 2,082,796 6/1937 Gaertner ..... 366/307
3,404,870 10/1968 Multer ..... 366/307

FOREIGN PATENT DOCUMENTS 1220113 1/1971 United Kingdom ..... 366/306

*Primary Examiner*—Robert W. Jenkins
*Attorney, Agent, or Firm*—Gunn, Lee & Jackson

[57] ABSTRACT

A containment and circulating system for drilling fluid is provided having generally circular tank means for receiving drilling fluid from a well during well drilling operations and from which the drilling fluid is withdrawn and injected into the well. The system incorporates a plurality of generally cylindrical tanks having cylindrical side wall means in normal relation with a substantially planar bottom wall. On opposed sides of each circular tank is provided angulated flow directing walls which intersect both the side wall and bottom wall. The flow directing walls receive the radiating flow from the impeller and direct it upwardly along opposed portions of the cylindrical side wall of the tank. An impeller is centrally located at the lower portion of each tank thereby inducing radiating flow of drilling fluid toward the lower outer wall structure of each tank. A pair of opposed flow lifting baffles are positioned in close proximity to the internal cylindrical surface defined by the tank wall and function to induce an upwardly directed component flow to the drilling fluid as it is circulated within the tank. The cooperating flow inducing activity of the flow directing walls and the flow lifting baffles develop controlled turbulence with minimal impeller force throughout the tank to retain substantially all of the solid particulate of the drilling fluid in suspension.

10 Claims, 5 Drawing Figures

CIRCULAR CONTAINMENT SYSTEM FOR WELL DRILLING FLUID

FIELD OF THE INVENTION

This invention relates generally to containment and circulating systems for drilling mud and more specifically concerns circular containment and circulating tanks having a central flow inducing impeller and cooperative flow directing and lifting means which create sufficient controlled turbulence to prevent settling of solid particulate at the bottom of each of the tanks.

BACKGROUND OF THE INVENTION

In the distant past, drilling fluid containment systems for well drilling operations were typically accomplished by means of mud pits dug in the ground in the immediate vicinity of the drilling rig. Drilling fluid, typically referred to as drilling mud, emerging from the well being drilled would typically be directed into the mud pits. Larger solid particulate, such as drill cuttings, would settle immediately and the remaining drilling fluid, with much of its required solid particulate constituents, would be directed toward the suction of the mud pumps. The mud pumps simply would draw drilling fluid from the mud pits and pump it back into the circulating system of the drilling rig. A significant amount of required constituents of the drilling fluid was typically lost along with the drill cuttings, sand and silt since the drilling mud was allowed to settle and not typically agitated during settling. It was necessary, therefore, to continuously replace a substantial quantity of lost solid particulate such as barite immediately prior to recirculation of the drilling fluid into the well.

Since the solid constituents of drilling fluid represent a significant expense, it became desirable to ensure that as much as the solid constituents as possible were retained for reuse. It was also desirable to accomplish well drilling operations with as little quantity of drilling fluid as was necessary, thereby further controlling the expense of drilling operations.

In the more recent past, therefore, the drilling industry has developed the use of portable mud containment and circulating systems incorporating a plurality of mud tanks which are interconnected by means of piping. These mud tanks are typically of rectangular configuration and are formed simply by welding metal plates in assembly. In order to develop turbulence in the tanks, impellers are typically provided in the central portion of the tank to generate turbulant flow radiating toward the bottom portion of the side walls of the tanks. In order to minimize the quantity of drilling fluid required for drilling operations, the drilling fluid emerging from the well is typically subjected to preliminary treatment for separation of larger solids before the drilling fluid is deposited in the first one of the mud tanks. For example, shale shakers are employed to separate drill cuttings by means of vibratory screening process. After removal of the drill cuttings, smaller particulate such as sand and silt are also be removed. The drilling fluid entering the first one of the mud tanks typically incorporates the usual drilling fluid constituents such as barite and other requisite components of the drilling mud along with a certain amount of sand and silt that is not removed by way of the preliminary screening treatment. The drilling fluid in the first one of the mud tanks is, therefore, considered contaminated and is unsuitable for use in further drilling operations without subsequent treatment. Subsequent treatment is typically accomplished by means of desander and desilter separators of centrifugal nature.

The mud tanks typically employed during drilling operations are required to contain sufficient drilling fluid for continuous circulation for normal drilling with a small amount of drilling fluid being continuously added to accommodate losses into the formation being drilled and to also accommodate the increasing dimension of the hole being drilled. It is extremely important to maintain sufficient quantity of drilling fluid to kill the well in the event the conditions of possible blowout are encountered. If a gas pocket is encountered and gas begins to enter the well bore, the hydrostatic head of the column of drilling fluid in the well bore will typically be reduced since the specific gravity of the heavy liquid drilling fluid is reduced by the presence of gas. To prevent a well blowout, it is typically necessary to pump drilling fluid rapidly into the bottom portion of the well bore to develop a hydrostatic head in the well bore which is in excess of the pressure of production fluid at the bottom of the well bore, thus preventing gas and other production fluid from entering the well bore. When rectangular drilling fluid containment systems are employed, sediment begins to develop at the corner portions of the tank where the side walls and bottom wall intersect because of the lack of fluid turbulence in these areas. This sediment buildup can severely reduce the volume of drilling fluid such that insufficient volume drilling fluid remains for adequate well control to prevent well blowout. To compensate for the buildup of sediment, conventional mud tanks generally have much more volumetric capacity than is actually required for drilling and for maintenance of a safe drilling fluid reserve. This excessive fluid volume adds cost and is, of course, detrimental to the commercial aspects of the drilling operation. Further, after drilling operations are terminated, the bottom and side wall portions of the drilling mud tanks sufficiently contain sufficient deposit of sediment that a significant amount of labor is required to remove it and thus render the mud tanks portable for transportation to other drilling sites. The volume of sediment in the bottom portion of drilling fluid tanks is typically of sufficient concern that the tanks must be checked quite often. Actual physical measurements must be taken to ensure that the remaining volumetric capacity of the drilling mud tanks is sufficient to contain the necessary volume of fluid for purposes of well safety. It is, of course, desirable to provide a drilling fluid containment and circulating system incorporating drilling fluid tanks which have the capability to remain free of any sediment, thereby ensuring that the tanks always contain sufficient volume of drilling fluid for purposes of well safety. It is also desirable that drilling fluid tanks be provided which do not require manual labor for sediment cleaning after well drilling operations have been terminated.

When impellers are utilized to agitate the drilling fluid in conventional rectangular mud tanks, a vortex typically develops which has the detrimental effect of severely restricting the volume of fluid circulation to the immediate central portion of the mud tank. In this case, only the center portion of the drilling fluid is agitated or circulated and dead spots develop in the peripheral portion of the tank, allowing settling. It is desirable to ensure turbulence through the drilling fluid volume in all areas of the mud tank to thus prevent or retard settling.

SUMMARY OF THE INVENTION

It is, therefore, a primary feature of the present invention to provide a novel containment and circulating system for well drilling fluid which includes drilling fluid tanks which remain substantially free of sediment during well drilling operations.

It is also a feature of this invention to provide a novel containment system for well drilling fluid whereby sufficient turbulence and flow is developed within the drilling fluid tanks to maintain the solid constitutents such as barite and contaminant particulate such as sand and silt in suspension within the drilling fluid, thereby enabling drilling fluid cleaning apparatus such as desanders and desilters to provide optimum preparation of the drilling fluid before recirculation within the well.

It is also a feature of this invention to provide a novel containment system for well drilling fluid wherein efficient mud cleaning operations are continuously conducted and the cleaned drilling fluid recirculated into the well is substantially free of contaminants, thereby minimizing abrasive wear of the drill bit, bearings and drill pipe.

It is an even further feature of this invention to provide a novel containment system for well drilling fluid which retards and substantially eliminates the development of a vortex as the drilling fluid is circulated by means of an impeller for the purpose of suspension inducing turbulence.

It is an even further feature of this invention to provide a novel containment system for well drilling fluid which is efficiently designed to prevent settling of contaminants and drilling fluid constituents such as barite, sand and silt.

It is also a feature of this invention to provide a novel containment system for well drilling fluid whereby sediment at the juncture of the side wall and bottom wall of drilling fluid tanks is substantially eliminated.

It is an even further feature of this invention to provide a novel containment system for well drilling fluid whereby fluid circulation and turbulence necessary to retain all of the particulate in suspension is accomplished by means of minimal horse power output of the impeller drive system thereof.

Briefly, the foregoing features and objections of this invention are accomplished by means of a drilling fluid containment and circulating system incorporating a plurality of generally circular tanks having series fluid communication enabling drilling fluid to be transferred from one tank to the other. Typically a drilling fluid containment and circulating system, according to this invention, incorporates three drilling fluid tanks arranged in series connection. The first two of the series connected tanks contain drilling fluid which is continuously being cleaned by means of desander and desilter equipment. The third drilling fluid tank contains cleaned drilling fluid that is ready for recirculation into the well bore. Various additives may be introduced into the clean drilling fluid in the last one of the series connected tanks or by means of subsequent fluid handling systems in order to ensure that it contains proper constitutents that are required for the particular character of drilling operations that are taking place.

Each of the drilling fluid tanks is of generally cylindrical configuration as mentioned above and is provided with opposed flow directing walls that are inclined with respect to the vertical and horizontal and which intersect both the flat bottom wall and the cylindrical side wall of the tank. Each tank incorporates an impeller which is located adjacent the central lower portion of the tank and which is driven by means of a suitable rotary power source that accomplishes rotation of an impeller shaft. The impeller power source may be an electrical motor, a rotary hydraulic motor or a motor of any other suitable character. As the impeller rotates, flow of drilling fluid is directed radially from the impeller outwardly toward the general area of intersection between the flat bottom wall and the cylindrical side wall of the tank. The opposed planar flow directing walls, being inclined with respect to the bottom wall and side wall, cause this downwardly and outwardly directed radiating flow of fluid to change to an upward direction thereby developing a significant amount of vertically rotating turbulence in the drilling fluid contained within the tank. Since the tank is of essentially circular form and with the radiating flow produced by the impeller being directed at the juncture of the bottom wall and circular side wall, there is sufficient turbulence to substantially eliminate sediment even at this juncture. There are no corners defined such as in rectangular mud tanks to permit deposits of sediment due to poor circulation and turbulence.

To provide the circulating drilling fluid with a lifting function and to prevent the development of a vortex within the mud tank, a pair of opposed flow lifting baffles are positioned inside the tank. These baffles are slightly spaced from the cylindrical side wall of the tank and may also be spaced from the top edge of the side walls and from the bottom wall. The baffles are also slightly inclined, i.e. in the order of 5° or so from the vertical, and are oriented with respect to the direction of fluid rotation as to ensure that the horizontally revolving flow of fluid induced by the impeller is induced to have an upwardly directed component of flow. The flow lifting baffles provide lift to the flowing fluid to create the proper turbulence needed to keep the solid particulate suspended in the drilling fluid. The cooperative relationship of the flow directing walls and the flow lifting baffles provide sufficient turbulence and controlled circulation to keep the bottom portion of the tank, including the area at the intersection of the bottom wall with the side wall, clear of any sediment. Since the particulate will always remain in suspension within the drilling fluid, the cleaning equipment such as silt and sand separators will be capable of functioning continuously and efficiently to remove sand and silt from the drilling fluid. The resulting cleaned drilling fluid, therefore, is unusually free of abrasive particulate thus minimizing wear of the drill bit, bearings and drill stem. In this manner, the bottom portion of the drilling fluid tanks will remain clear of any deposits of sediment and the entire volume of the tanks is, therefore, always available for well drilling and well safety. The drilling mud tanks may, therefore, be of substantially less volumetric dimension as compared to the dimension of typical rectangular drilling fluid tanks without detracting from well safety.

Other and futher objects, advantages and features of the present invention will become apparent to one skilled in the art upon consideration of this entire disclosure, including the specification and the annexed drawings. The form of the invention, which will now be described in detail, illustrates the general principals of the invention but it is to be understood that this detailed description is not to be taken as limiting the scope of the present invention.

BRIEF DESCRIPTION OF THE DRAWINGS

So that the manner in which the above recited features of the present invention can be understood in detail, more particular description of the invention, briefly summarized above, may be had by reference to the embodiment thereof which is illustrated in the appended drawings, which drawings form a part of this specification.

It is to be noted, however, that the appended drawings illustrate only a typical embodiment of the invention and are, therefore, not to be considered limiting of its scope, for the invention may admit to other equally effective embodiments.

IN THE DRAWINGS

Figure 1:
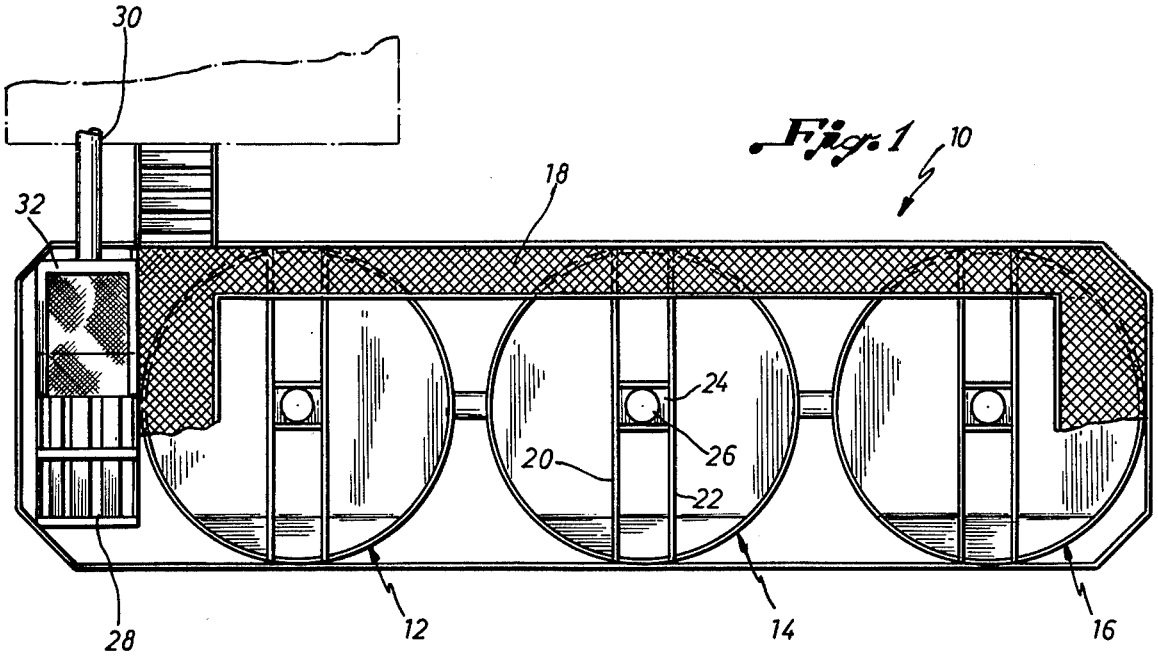

FIG. 1 is a plan view of a drilling fluid containment and circulating system having three drilling fluid tanks that are constructed in accordance with the present invention.

Figure 2:
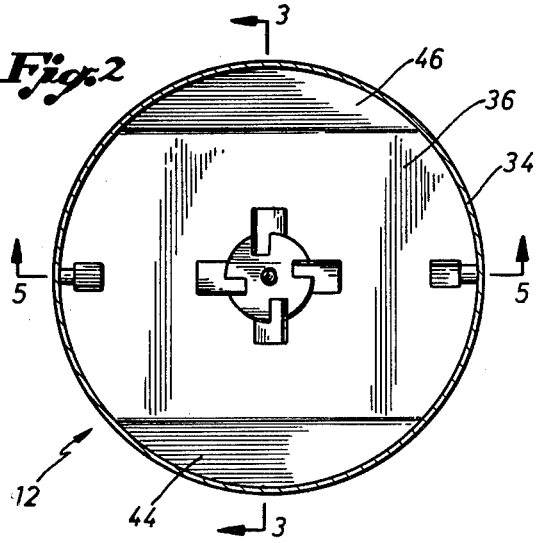

FIG. 2 is a plan view of a single drilling fluid tank such as shown in FIG. 1 with the superstructure thereof removed to illustrate inner portions of the tank structure.

Figure 3:
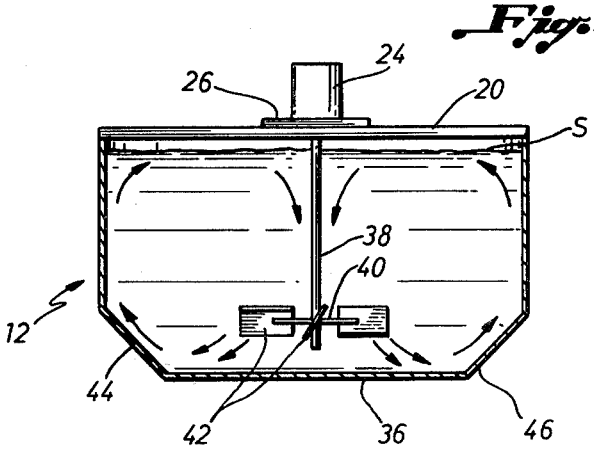

FIG. 3 is a sectional view taken along line 3—3 of FIG. 2 and illustrating, by means of flow arrows, the character of fluid circulation that is achieved by the flow directing wall structure thereof.

Figure 4:
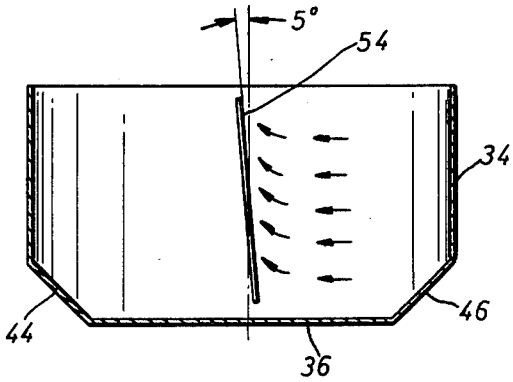

FIG. 4 is a sectional view similar to that of FIG. 3 and illustrating, by means of flow arrows, the lifting effect of the opposed lifting baffles of the drilling fluid tank.

Figure 5:
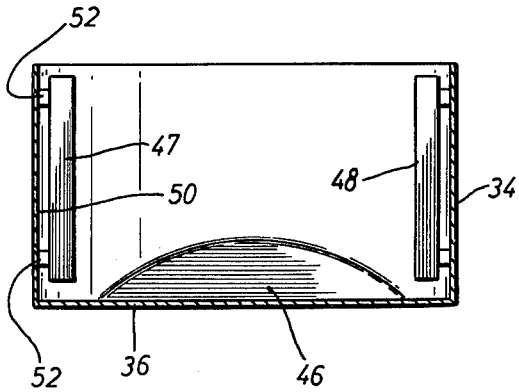

FIG. 5 is a sectional view taken along line 5—5 of FIG. 2, illustrating the relation of the flow lifting baffles and flow directing walls to the bottom wall and side wall of the tank. DETAILED DESCRIPTION OF PREFERRED EMBODIMENT Referring now to the drawings and first to FIG. 1, a drilling fluid containment and circulating system is illustrated generally at 10 which incorporates three circular drilling fluid tanks shown generally at 12, 14 and 16 which are constructed in accordance with the principals of this invention. Above the level of the drilling fluid tanks 12, 14 and 16, is located a personnel walkway 18 enabling personnel to gain access to the upper portions of the tanks for inspection of both mechanical apparatus and the characteristics of the drilling fluid and for conducting various servicing activities. As shown in FIG. 1, for the purpose of simplicity, portions of the walkway structure have been broken away to expose the upper portions of the drilling fluid tanks.

At the upper portions of each drilling fluid tank is provided transverse impeller support structure such as shown at 20 and 22 having impeller mounting means 24 located intermediate the extremities thereof. The mounting means 24 provides support for an impeller drive motor 26 which may take any convenient form such as might be electrically powered, hydraulically energized, etc. within the spirit and scope of the present invention.

At one end of the drilling fluid containment and circulating system 10 is provided a receptacle 28 which receives drilling fluid emerging from the well by means of a conductor line 30. A shale shaker 32 or other suitable separator apparatus is typically provided to separate out larger particulate such as drill cuttings as the drilling fluid emerges from the conductor line. After being screened by the shale shaker 32 or other preliminary separator apparatus, the drilling fluid then enters the first one of the series connected drilling fluid tanks 12, 14 and 16. The drilling fluid will contain sand and silt which passes through the preliminary separation process and is thus considered to be contaminated and unsuitable for reuse without further cleaning.

As shown in FIG. 2, the impeller support structure 20–26 is shown to be removed to expose the interior of the tank 12 to thus enable a ready understanding of the structure thereof. The tank 12 is exemplary of the general structure of each of the drilling fluid tanks 12, 14 and 16 of FIG. 1. The drilling fluid tank 12 incorporates a generally cylindrical side wall 34 and a generally planar bottom wall 36 which are typically formed of metal plate material in welded assembly. Although the diameter of the circular side wall 34 is not critical to the present invention, typical drilling fluid tanks constructed in accordance with this invention will have a diameter in the order of from ten feet to twelve feet.

Referring now to FIG. 3 which is a sectional view taken along line 3—3 of FIG. 2, the impeller motor 26 imparts rotational movement to an impeller shaft 38 having an impeller support plate 40 at the lower extremity thereof which provides support for a plurality of impeller blades 42. Upon the energization of the impeller motor 26, the impeller rotates, creating turbulent flow in the drilling fluid tank such as shown by the flow arrows in FIG. 3. On opposed sides of the tank, the tank wall structure is defined by opposed angulated flow directing walls 44 and 46 which intersect the bottom wall along parallel chord lines and which intersect the side wall along curved lines with the extremities of the parallel chord lines and curved lines coinciding. As shown, the flow directing walls are angulated with respect to both the cylindrical side wall 34 and the planar bottom wall 36 at an angle of 45°. This particular angular relationship is not intended to limit the present invention in any manner whatever. As the flow of drilling fluid is directed downwardly and outwardly in radial manner responsive to rotation of the impeller, it is deflected by the bottom wall 36 to a more upward direction. Thereafter, it is again deflected by the opposed angulated flow directing walls 44 and 46 thereby becoming more upwardly directed as shown by the flow arrows in FIG. 3. The flowing drilling fluid, upon leaving the flow directing walls 44 and 46 continues upwardly along the vertically oriented cylindrical side wall 34 to the surface level S of the drilling fluid. Upon reaching the vicinity of the surface S, the flowing fluid will change to a direction toward the center of the tank. After reaching the central portion of the tank, the flow direction will change again toward the bottom of the tank under the suction developed by the rotating impeller. The fluid circulating pattern will, therefore, take the form shown by the flow arrows in FIG. 3. This pattern of fluid flow is referred herein as being in the vertical mode, i.e. upwardly along the outside of the tank and downwardly at the central part of the tank.

As the impeller blades 42 are rotated, the drilling fluid will also take on a rotary pattern of flow as viewed in plan which is referred to herein as being in the horizontal mode. In some cases, this rotary pattern of flow could develop a vortex at the central portion of the tank thereby minimizing turbulent circulation along the outer wall structure thereof. In such case, minimized circulation at the wall structure could allow deposit of sediment because of the lack of turbulence at the outer peripheral portion of the tank. In order to prevent the formation of a vortex and to ensure the continuous upwardly directed flow of fluid to enhance particulate retention in suspension, a pair of opposed flow lifting baffles are positioned along the cylindrical side walls of the tank. The flow lifting baffles 46 and 48 are supported in slightly spaced relation with the inner wall surface 50 of the cylindrical wall 34 by means of a plurality of supports 52. If desired, the supports 52 may be welded or otherwise fixed to the inner wall surface 50 of the tank. The flow lifting baffles may also be welded or othewise fixed to the supports 52 so as to render them fixed within the tank structure. As shown in FIG. 4, the flow lifting baffles are slightly angulated with respect to the vertical with an upwardly inclined surface 54 being presented to the rotatably circulating fluid. This slight baffle angulation may be from 2° to 10° in relation to the vertical or more desirably about 5° in relation to the vertical. As shown by the flow arrows in FIG. 4, the rotating fluid may be essentially stratified along those portions of the cylindrical wall structure that are substantially 90° offset from the flow directing walls 44 and 46. The outer portions of this rotating flow of drilling fluid will engage the upwardly inclined surface 54 of the baffle thereby imparting an upward component of flow as shown by the flow arrows, inducing lifting effect that tends to move the drilling fluid liquid and its particulate constitutents upwardly. This feature prevents settling of the solid constituents of the drilling fluid.

Since the baffles are located in slightly spaced relation with respect to the inner wall surface 50 of the tank, fluid flow path is created between the baffle and the wall structure which prevents any sediment from developing in the immediate vicinity of the baffle. Each of the baffles is also positioned in spaced relation with respect to the bottom wall 36 of the tank, thereby preventing any dead spots in the flowing fluid that might otherwise allow the deposit of sediment.

The cooperative relationship of the fluid circulation shown by the flow arrows in FIG. 3, with the fluid circulation shown by the flow arrows in FIG. 4, provide sufficient turbulence within the drilling fluid tank that all of the particulate constitutents thereof are efficiently retained in suspension. The bottom 36 and the lower portions of the side walls, especially at the juncture of the side walls and bottom will thereby remain free of any sediment. Since the particulate constitutents are retained in suspension, including those contaminant constituents such as sand, silt, etc., the centrifugal fluid cleaning apparatus will be capable of functioning efficiently and continuously thus providing drilling fluid at the last one of the series oriented drilling fluid tanks which is cleaned of particulate to an optimum degree. Drilling fluid being recirculated into the well, therefore, is more efficiently cleaned of abrasive particulate as compared to conventional drilling fluid containment and circulation systems, therefore, allowing drilling operations to continue with minimized abrasive wear of the drill bit, drill bearings and drill stem.

Since the drilling fluid tanks of the present invention remain free of sediment during containment and circulation activities, there will always remain an adequate volume of drilling fluid within the tanks to ensure not only continuous well drilling operations, but also well safety. Moreover, the circular configuration of the drilling fluid tanks and the controlled turbulence that is promoted by the efficiently designed structure thereof permits agitation by means of a rotary impeller with minimized introduction of power. For example, it has been determined, through tests, that approximately one-half of the power input is required for achieving impeller induced fluid turbulence as compared to conventional drilling fluid containment and circulation systems.

It is, therefore, evident that this invention is one well adapted to attain all of the objects and advantages hereinabove set forth, together with other advantages which will be become obvious and inherent from a description of the apparatus itself. It will be understood that certain combinations and subcombinations are of utility and may be employed without reference to other features and subcombinations. This is contemplated by and is within the scope of the present invention.

What is claimed is:

1. Containment and circulating tank means for receiving drilling fluid from a well during well drilling operation and from which said drilling fluid is withdrawn and injected into the well, said tank means comprising:

(a) generally horizontal bottom wall means of substantially planar configuration;

(b) generally cylindrical side wall means secured in substantially normal relation to said bottom wall means;

(c) a pair of inclined flow directing walls being secured to said bottom wall means and said side wall means, said flow directing walls being of generally planar configuration and intersecting said bottom wall means at chords of a circle defined by said cylindrical side wall means, said flow directing walls each intersecting said cylindrical side wall means at a curved line having each extremity thereof at respective extremities of said chords;

(d) flow inducing means directing flow of drilling fluid radially outwardly from the lower central portion of said tank toward the bottom portion of said inclined flow directing wall means and said cylindrical side wall means; and (e) flow lifting means being provided internally of said cylindrical wall means.

2. Containment and circulating tank means as recited in claim 1, wherein:

said flow directing walls are oriented substantially 180° apart and intersect both said bottom wall means and side wall means at an angle of substantially 45°.

3. Containment and circulating tank means as recited in claim 1, wherein said flow lifting means comprises:

baffle plate means disposed in angular relation with said cylindrical wall means and in inclined relation with respect to the vertical.

4. Containment and circulating tank means as recited in claim 3, wherein:

said baffle plate means extends from a position of spaced relation with the upper extremity of said cylindrical wall means to a position in spaced relation with said bottom wall means.

5. Containment and circulating tank means as recited in claim 4, wherein:

said baffle plate means cooperates with said side wall means to form opening means permitting circulation of fluid between said baffle plate means and said cylindrical side wall means.

6. Containment and circulating tank means as recited in claim 4, wherein:

said baffle plate means is of narrow strip form and defines a substantially straight free edge extending from its upper extremity to the lower extremity thereof.

7. Containment and circulating tank means as recited in claim 6, wherein:

said baffle plate is supported by said cylindrical side wall means.

8. Containment and circulating tank means as recited in claim 1, wherein said flow lifting means comprises:

baffle plate means of generally planar configuration and in the form of an elongated strip being positioned in substantially radial orientation with respect to said side wall means, said baffle plate means being inclined in the range of from about 1° to about 10° and preferably about 5° with respect to the verticle.

9. Containment and circulating tank means as recited in claim 1, wherein said flow inducing means comprises:

(a) an impeller located adjacent the central portion of said bottom wall means and being rotated about a generally vertically oriented axis of rotation said impeller directing flow of said drilling fluid downwardly and outwardly in radiating manner; and (b) means for imparting rotation to said impeller.

10. Containment and circulating tank means as recited in claim 1, wherein:

said flow directing walls are positioned in opposed relation and said chords are disposed in substantially parallel relation.

* * * * *